US010765598B2

(12) United States Patent
Cheung et al.

(10) Patent No.: US 10,765,598 B2
(45) Date of Patent: Sep. 8, 2020

(54) NEGATIVE PRESSURE DEVICE AND METHODS THEREOF

(71) Applicant: Yun Yu Cheung, Sheung Shui (HK)

(72) Inventors: Yun Yu Cheung, Hong Kong (HK); Hon San Sung, Hong Kong (HK); Geng Li, Hong Kong (HK)

(73) Assignee: Yun Yu Cheung, Sheung Shui, New Territories (HK)

( * ) Notice: Subject to any disclaimer, the term of this patent is extended or adjusted under 35 U.S.C. 154(b) by 1023 days.

(21) Appl. No.: 15/251,682

(22) Filed: Aug. 30, 2016

(65) Prior Publication Data

US 2017/0112708 A1 Apr. 27, 2017

Related U.S. Application Data

(60) Provisional application No. 62/245,246, filed on Oct. 22, 2015.

(30) Foreign Application Priority Data

Aug. 12, 2016 (CN) ..... 2016 1 0658388

(51) Int. Cl.
*A61H 9/00* (2006.01)
*A61H 39/08* (2006.01)

(52) U.S. Cl.
CPC ..... *A61H 39/086* (2013.01); *A61H 39/083* (2013.01); *A61H 2201/1238* (2013.01); (Continued)

(58) Field of Classification Search
CPC ..... A61H 39/086; A61H 39/083; A61H 2205/04; A61H 2205/02; A61H 2205/067; A61H 2201/5043; A61H 2201/50; A61H 2201/1238; A61H 2205/10; A61H 2205/06; A61H 2205/022
See application file for complete search history.

(56) References Cited

U.S. PATENT DOCUMENTS 6,117,155 A * 9/2000 Lee ..... A61B 90/50 606/189
7,828,748 B2 11/2010 Hibner
(Continued)

FOREIGN PATENT DOCUMENTS

CN 87206017 1/1988
CN 1088419 A 6/1994
(Continued)

*Primary Examiner* — Quang D Thanh
(74) *Attorney, Agent, or Firm* — Kilpatrick Townsend & Stockton LLP

(57) ABSTRACT

The present invention relates to a negative pressure device, including: a hollow needle assembly including: a hollow needle adaptor, the hollow needle adaptor has an axial through hole, a proximal connector, a distal connector and a flange between the proximal connector and the distal connector, and at least one hollow needle, each of the at least one hollow needle has a tip and an axial through hole and is in fluid communication with the proximal connector of the hollow needle adaptor; a host machine, the host machine includes a control module and a vacuum pump; and an exhaust pipe, the exhaust pipe is in fluid communication with the host machine and the distal connector of the hollow needle adaptor.

13 Claims, 5 Drawing Sheets

(52) U.S. Cl.
CPC .. *A61H 2201/50* (2013.01); *A61H 2201/5043* (2013.01); *A61H 2205/02* (2013.01); *A61H 2205/022* (2013.01); *A61H 2205/04* (2013.01); *A61H 2205/06* (2013.01); *A61H 2205/067* (2013.01); *A61H 2205/10* (2013.01)

(56) References Cited

U.S. PATENT DOCUMENTS

2008/0214909 A1* 9/2008 Fuerst ..... A61B 5/14514
600/309
2010/0042137 A1* 2/2010 Oronsky ..... A61H 39/083
606/204
2011/0245856 A1* 10/2011 Su ..... A61H 39/086
606/189

FOREIGN PATENT DOCUMENTS

| | | | |
|---|---|---|---|
| CN | 1422607 | | 6/2003 |
| CN | 101125093 | A | 2/2008 |
| CN | 201271279 | Y | 7/2009 |
| CN | 202051898 | U | 11/2011 |
| CN | 102646354 | A | 8/2012 |
| CN | 103070706 | | 5/2013 |
| CN | 203469024 | | 3/2014 |
| CN | 203483654 | | 3/2014 |
| CN | 204364438 | | 6/2015 |
| EP | 2377475 | | 10/2011 |
| WO | 94/08654 | A3 | 4/1994 |

* cited by examiner

NEGATIVE PRESSURE DEVICE AND METHODS THEREOF

FIELD OF THE INVENTION

The present invention relates to a hollow needle machine having an acupuncture needle with a channel and connected to a negative pressure device. A negative pressure device and method using the negative pressure device for prevention, treatment and recovery of disease, particularly a hollow needle device and method of inserting a needle with channel into the connective tissue under the skin of a patient, and sleeve-coupling a rubber tube, one end of the rubber tube is sleeve-coupled with the needle with channel, and the other end of the rubber tube is sleeve-coupled with a healthcare machine for dredging meridians and collaterals, which stimulates the acupoints via appropriate negative pressure. Due to the use of negative pressure, the six exogenous pathogens, i.e. wind, cold, summer heat, humidity, dryness and fire accumulated in the body can be extracted, the obstructed meridians and collaterals can be dredged, the end of open all the channels and to cure all the diseases can be reached. This is a completely new acupuncture method, it breaks people's stereotype about traditional acupuncture as being highly dependent on personal skills and expertise. The emergence of the hollow needle is a breakthrough of the acupuncture therapy. The present invention relates to a method of operating the hollow needle device and methods using the hollow needle device to dredge meridians and collaterals to achieve prevention, treatment and recovery of diseases.

BACKGROUND OF THE INVENTION

《Jing Yue Quan Shu》 points out "all internal diseases have external symptoms", it means lesion of internal organs can be reflected as certain symptoms or positive reaction points at parts or respective body surfaces where the meridians and collaterals pass. Therefore, acupuncture of certain parts, acupoints or positive reaction regions can dredge the meridians and collaterals, adjust deficiency and excess of the viscera, adjust the qi and blood, and balance ying and yang. Research of modern acupuncture and meridian biophysics indicates, having acupuncturing any acupoints, the stimulation tends to reach the organs associated with the acupoints along the layout of the meridians and collaterals even without subjective feeling, resulting healthcare and/or treatment effects.

However, acupuncture is a sophisticated science. A significant portion of knowledge is know-how expertise. No single acupuncture therapy is universal. To achieve good healthcare and treatment effects, every acupuncturist has to master a variety of acupuncture therapies, and to apply a relatively appropriate one for different sicknesses. Besides, despite some acupuncture therapy may be effective upon the first use, it becomes less effective with subsequent frequent use within a short period. In addition, traditional acupuncture therapy may result needling sensation of soreness, numbness, swell and pain, and has the problem of long duration of needle retention.

In this regard, a quick-acting, safe, low or non-pain acupuncture therapy without damage to healthy tissues, causing scars or sequelae is desirable.

SUMMARY OF THE INVENTION

In this regard, the present invention provides a hollow needle device and methods using the hollow needle for dredging the meridians and collaterals to achieve healthcare and treatment effects. The hollow needle device and method of the present invention can be used to dredge the meridians and collaterals, to regulate qi and blood, and thereby to cure or relieve various symptoms such as intractable pain, paralysis and numbness of limbs resulting from the obstruction of the meridians and collaterals and the retardation of qi and blood. In addition, the hollow needle device and method of the present invention can improve microcirculation around the lesion, eliminate inflammatory medium and relieve spasm. The hollow needle device and method of the present invention for treating or relieving diseases take effect quickly, are safe, cause little pain to patients, and have long lasting effect. The therapeutic effect is way above the traditional acupuncture device and method.

In one embodiment, the present invention discloses a negative pressure device comprising: a hollow needle assembly including: a hollow needle adaptor, said hollow needle adaptor having an axial through hole, a proximal connector, a distal connector and a flange between said proximal connector and said distal connector, and at least one hollow needle, each of said at least one hollow needle having a tip and an axial through hole, and being in fluid communication with said proximal connector of said hollow needle adaptor; a host machine, said host machine having a control module and a vacuum pump; and an exhaust pipe, said exhaust pipe being in fluid communication with said host machine and said distal connector of said hollow needle adaptor.

In a further embodiment, each of the at least one hollow needle further comprising a handle at the distal end of the tip, the handle being in fluid communication with the proximal connector of the hollow needle adaptor.

In a further embodiment, the hollow needle adaptor or the handle comprising a lug at the external circumferential surface thereof.

In a further embodiment, the tip of the at least one hollow needle having a diameter of 0.3-0.7 mm.

In a further embodiment, the control module comprising a time control module, a negative pressure control module, a negative pressure monitor and display module and a pump control module.

In a further embodiment, the flange of the hollow needle adaptor comprising a notch, the notch pointing at the same direction or in the same plane with the inclined plane at the tip of the through hole of the at least one hollow needle.

In one embodiment, the present invention discloses a method of operating a negative pressure device, comprising the steps of: acupuncturing at least one hollow needle beneath the skin of a patient to the subcutaneous connective tissue, each of the at least one hollow needle comprising a through hole, connecting the at least one hollow needle to a host machine, the host machine comprising a vacuum pump, and establishing a negative pressure in the through hole of the at least one hollow needle by means of the vacuum pump.

In a further embodiment, the negative pressure is set in accordance with different acupuncturing body parts as: 20-40 cmHg for head and face, 40 cmHg for neck, 70 cmHg for waist, 40-50 cmHg for fingers, 50-70 cmHg for upper limbs and 60-76 cmHg for lower limbs.

In a further embodiment, selecting the diameter of the tip of the hollow needle as 0.3-0.7 mm.

In a further embodiment, selecting the diameter of the tip of the hollow needle as 0.3-0.45 mm for face acupuncture.

In a further embodiment, selecting the diameter of the tip of the hollow needle as 0.5-0.7 mmtip for limbs acupuncture.

In a further embodiment, acupuncturing the skin at an angle of 15, 45 or 90 degrees relative to the skin.

In a further embodiment, selecting physical disorder parts as acupuncturing locations.

In a further embodiment, maintaining the negative pressure in the through hole of the hollow needle for no longer than 5 minutes.

In one embodiment, the present invention discloses a negative pressure treatment method, comprising the steps of: establishing a fluid channel between subcutaneous connective tissue and the external, and establishing a negative pressure in the fluid channel.

In a further embodiment, the fluid channel is achieved by means of a hollow needle having a through hole.

In a further embodiment, the diameter of the tip of the hollow needle is between 0.3-0.7 mm.

In a further embodiment, the negative pressure is set in accordance with different acupuncturing body parts as: 20-40 cmHg for head and face, 40 cmHg for neck, 70 cmHg for waist, 40-50 cmHg for fingers, 50-70 cmHg for upper limbs and 60-76 cmHg for lower limbs.

In a further embodiment, selecting physical disorder parts as acupuncturing locations.

In a further embodiment, maintaining the negative pressure for no longer than 5 minutes.

BRIEF DESCRIPTION OF THE DRAWINGS

To better understand the present invention, the embodiments will be explained in connection with the drawings, wherein.

DESCRIPTION OF EMBODIMENTS

Device

Figure 1:
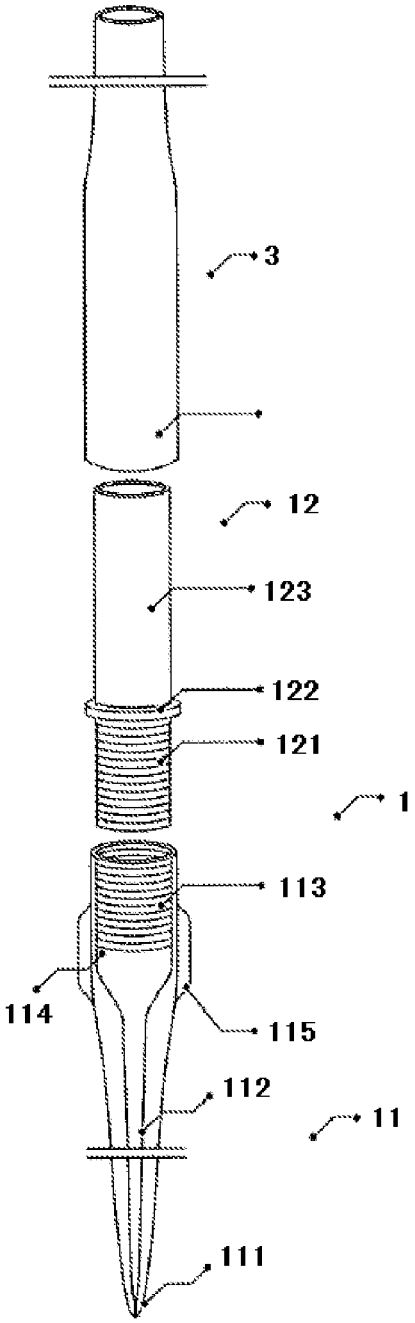
FIG. 1 is an illustrative view of the hollow needle assembly according to one embodiment of the present invention.

The hollow needle device of the present invention comprises a hollow needle assembly 1, a host machine 2 and an exhaust pipe 3 in fluid communication between them. The hollow needle assembly 1 comprises hollow needles 11 of various different sizes. In one embodiment, the hollow needles 11 of various different sizes comprise tips 111 with diameters of 0.3-0.7 mm and lengths of 15-100 mm. The tips 111 can be made of stainless steel; however, other biocompatible materials are possible. The tip 111 has a through hole 112 therein for suction operation, the through hole 112 has an inclined opening surface 116.

Figure 2:
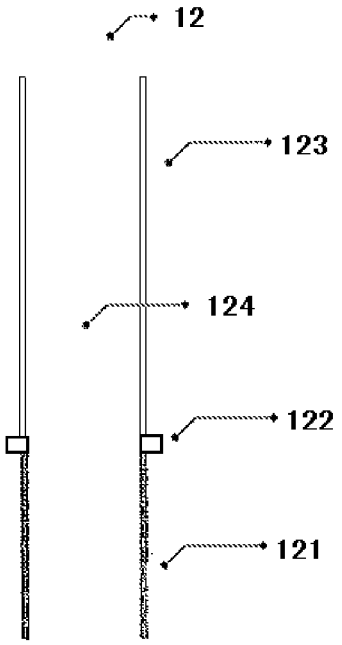
FIG. 2 is an illustrative view of the hollow needle adaptor according to one embodiment of the present invention.

In one embodiment as shown in FIG. 1 and FIG. 2, each hollow needle 11 further comprises a handle 113. The handle 113 receives and secures the tip 111, and has an internal channel 114 in fluid communication with the through hole 112 of the tip 111 to perform suction operation. The connection between the handle 113 and the tip 111 includes but is not limited to press fitting, adhesion, welding and integral forming. The external circumferential surface of the handle 113 has lugs 115 for hand gripping and applying force to acupuncturing the hollow needle 11 into the skin. However, other suitable surface structures are possible. In one further embodiment, the hollow needle 11 can be a conventional syringe needle with internal passage.

The hollow needle assembly 1 further comprises a hollow needle adaptor 12 coupled with the hollow needle 11. The use of the hollow needle adaptor 12 means the present invention does not have to use specifically designed and manufactured hollow needle, but can make use of the aforementioned syringe needle with internal passage. In the hollow needle adaptor 12 there is an axially extending through hole 124. The proximal end of the hollow needle adaptor 12 comprises a handle connector 121 coupled with the handle 113 to receive the hollow needle and to achieve physical and fluid connection. The handle connector 121 includes but is not limited to thread connection or bolt-lock connection. There is a flange 122 adjacent to the proximal end of the hollow needle adaptor 12 to limit the extent of coupling between the hollow needle adaptor 12 and the hollow needle 11, and to achieve fluid sealing after it is pressed against the distal end of the handle 113 after coupling. In a further embodiment, a gasket (not shown) can be provided on the flange 122 to assist sealing. The distal end of the hollow needle adaptor 12 opposite the proximal end comprises an exhaust pipe connector 123 for establishing physical and fluid connection with the exhaust pipe 3.

Figure 3A:
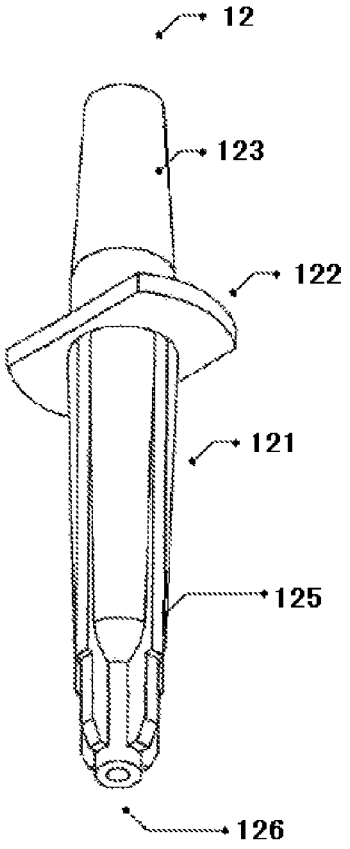
FIG. 3A is an illustrative view of the hollow needle adaptor according to one embodiment of the present invention.
Figure 3B:
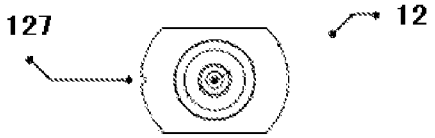
FIG. 3B is a top view of the hollow needle adaptor according to the embodiment of FIG. 3A.

In another embodiment as shown in FIG. 3A and FIG. 3B, the hollow needle 11 does not include a handle. The tip 111 of the hollow needle 11 is directly mounted to the hollow needle adaptor 12. The hollow needle adaptor 12 comprises a flange 122, a tip connector 121 at the proximal end of the flange 122 and an exhaust pipe connector 123 at the distal end of the flange. A through hole 124 extends axially along the hollow needle adaptor 12. In another embodiment, the through hole 124 can have a diameter of 2-3 mm. In another embodiment, the diameter of the through hole 124 decreases gradually from the distal end to the proximal end. The proximal end of the hollow needle adaptor 12 comprises an opening 126 to receive the hollow needle 11. The connection between the proximal end of the hollow needle adaptor 12 and the tip 111 includes but is not limited to press fitting, adhesion and welding. In this regard, an adhesion material, a welding material or a sealing material can be filled in the gap between the opening 126 of the hollow needle adaptor 12 and the received hollow needle 11. In any event, the connection between the opening 126 of the hollow needle adaptor 12 and the tip 111 ensures no fluid will leak through the gap between the tip 111 and the hollow needle adaptor 12. The external circumferential surface of the tip connector 121 of the hollow needle adaptor 12 comprises at least one lug 125 for hand-gripping and applying force to acupuncturing the hollow needle 11 into the skin. The exhaust pipe connector 123 of the hollow needle adaptor 12 comprises structures for establishing physical and fluid connection with the exhaust pipe 3.

Figure 3C:
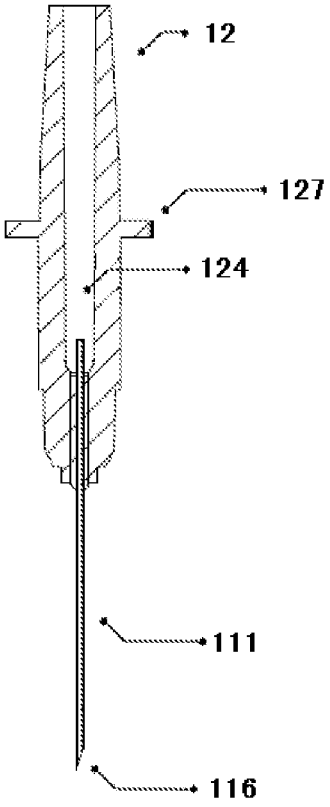
FIG. 3C is a section view of the hollow needle adaptor according to the embodiment of FIG. 3A.
Figure 4:
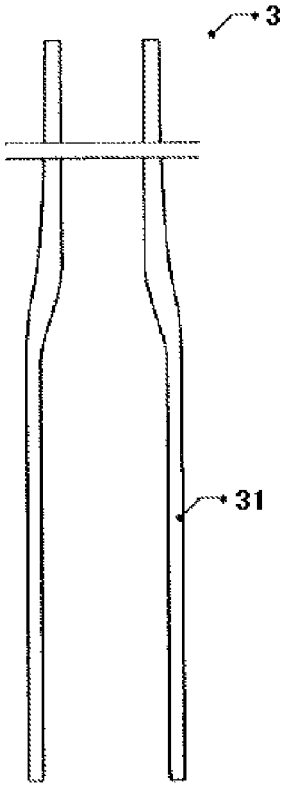
FIG. 4 is an illustrative view of the exhaust pipe according to one embodiment of the present invention.
Figure 5:
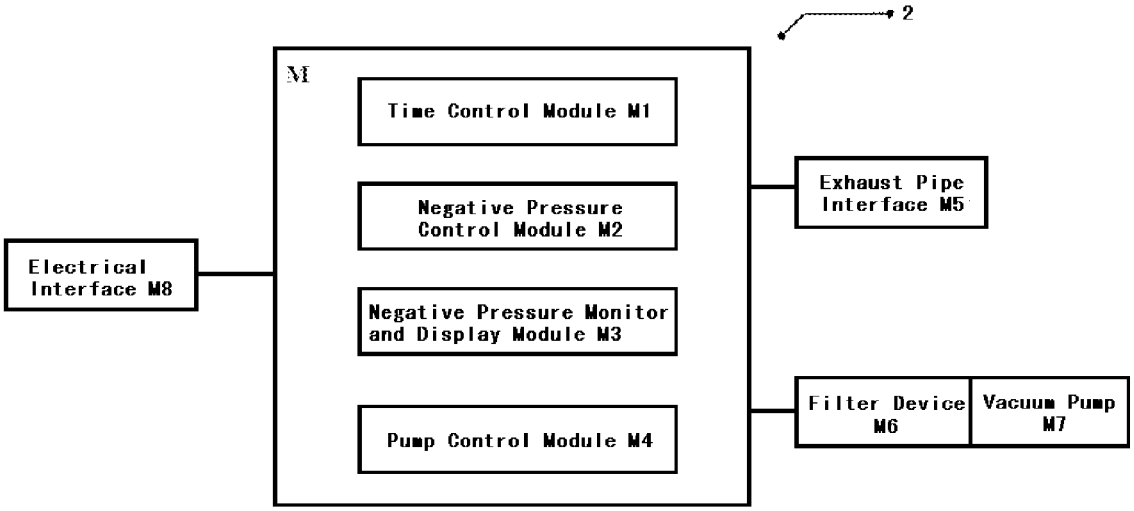
FIG. 5 is an illustrative view of the host machine according to one embodiment of the present invention.
Figure 6:
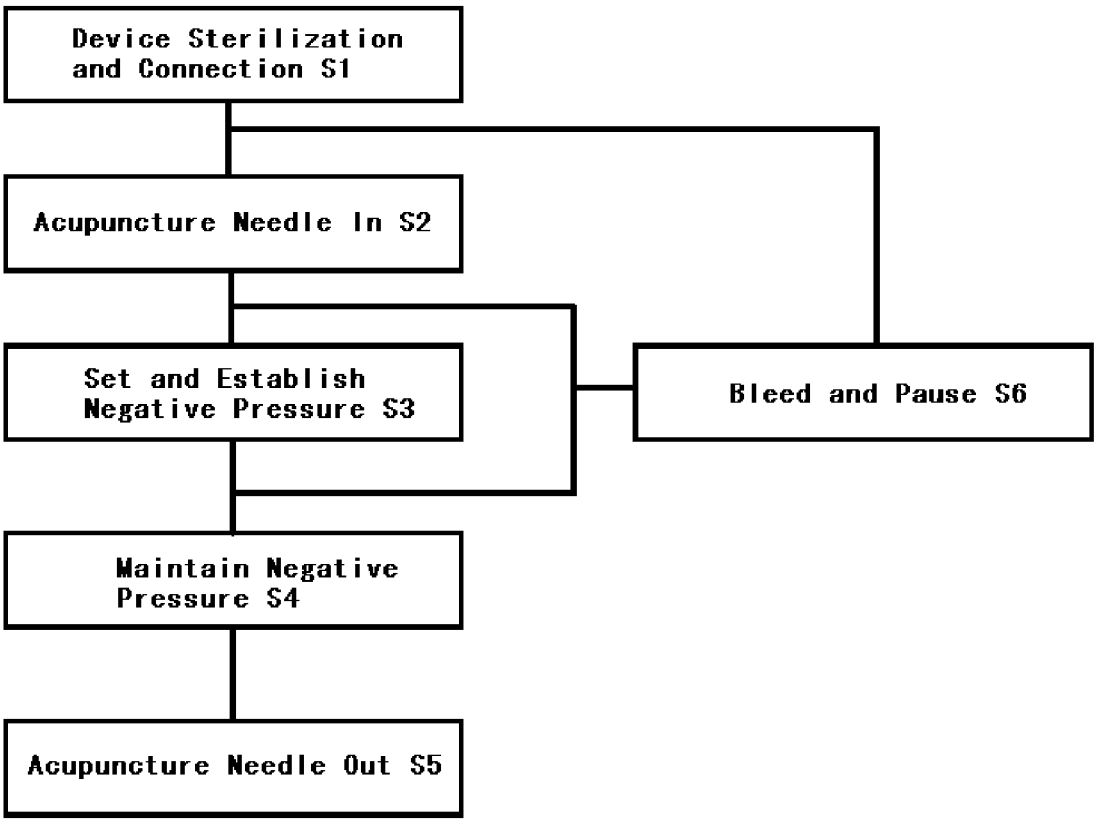
FIG. 6 is a flow diagram of the method according to one embodiment of the present invention.

In one embodiment, the flange 122 further comprises a notch 127. As shown in FIG. 3C, the notch 127 is pointing at the same direction with the inclined opening surface 116 of the through hole 112 of the tip 111, or they are pointing in the same plane. The notch 127 is made for the doctor to feel the orientation of the tip opening surface 116 by touch. This is especially advantageous during the acupuncturing process, particularly during the horizontal acupuncturing and inclined acupuncturing processes.

In one embodiment, the exhaust pipe connector 123 of the hollow needle adaptor 12 has a hollow cylindrical structure. In another embodiment, the exhaust pipe connector 123 of the hollow needle adaptor 12 has a hollow tapered structure. In still a further embodiment, the exhaust pipe connector 123 of the hollow needle adaptor 12 has a hollow structure comprised of a distal tapered portion and a proximal cylindrical portion. The exhaust pipe connector 123 establishes physical and fluid connection with the exhaust pipe 3. The exhaust pipe 3 preferably is made of soft plastic material, such that the exhaust pipe 3 can wrap and pinch the exhaust pipe connector 123 of the hollow needle adaptor 12. The flange 122 of the hollow needle adaptor 12 limits the extent of the wrapping of the exhaust pipe 3. The exhaust pipe 3 can have a suitable length to facilitate acupuncturing operation of doctor. In one embodiment, the end of the exhaust pipe 3 that connects the exhaust pipe connector 123 of the hollow needle adaptor 12 has a diameter-enlarged portion 31.

The host machine 2 of the hollow needle device of the present invention comprises a control module M. In one embodiment, the control module M comprises a time control module M1, a negative pressure control module M2, a negative pressure monitor and display module M3, a pump control module M4 etc. The time control module M1 is used to set the time of operation of the hollow needle device, i.e. the time of maintaining negative pressure. The negative pressure control module M2 is used to set the amount of negative pressure applied in the through hole of the tip 111. The negative pressure monitor and display module M3 is used to measure and display negative pressure. The pump control module M4 is used to operate a vacuum pump M7 to achieve the set negative pressure. In another embodiment, the host machine 2 can be integrated inside or connected outside the vacuum pump M7. The vacuum pump M7, for instance, is an aluminum micro air compressor. The vacuum pump can have a pre-filtering device M6 so as to prevent air or other pollutant from the hollow needle assembly 1 from contaminating or damaging the vacuum pump M7. The host machine 2 further comprises an exhaust pipe interface M5 to connect the exhaust pipe 3, and an electrical interface M8 for power input.

Method

Below is an introduction of a method using the hollow needle device of the present invention to dredge meridians and collaterals.

After completing sterilization and connection of related devices S1, an acupuncturist first inserts a hollow needle 11 into the affected part of a patient, particularly to the subcutaneous connective tissue S2. After the insertion, the acupuncturist switches on the host machine 2 to set the negative pressure in the through hole of the hollow needle 11, and operates the vacuum pump M7 to achieve the set negative pressure S3. After maintaining the negative pressure for a predetermined period of time S4, the hollow needle is withdrawn S5.

It is important to keep negative pressure in the through hole of the hollow needle 11. By no means can any air or drug enter the acupoints of human body.

Besides, there are a number of considerations in implementing the aforementioned method:

(1) Posture of body. During the acupuncture and application of negative pressure, a suitable posture of body should be chosen for the patient. The posture of body mainly comprises clinostatism and leaning posture, however other suitable postures are also possible.

(2) Selection of hollow needle. Suitable hollow needle 11 should be chosen from the hollow needle assembly 1 consisting of hollow needles 11 of different sizes for treatment. The selection of size of hollow needle is dependent on the parts to be treated and the seriousness of the sickness. In one embodiment, hollow needle 11 having a tip 111 diameter of 0.3-0.45 mm is selected for face, hollow needle 11 having a tip 111 diameter of 0.5-0.7 mm is selected for limbs.

(3) Angle of needle insertion. Horizontal insertion, oblique insertion or vertical insertion can be chosen for different parts. For horizontal insertion the hollow needle 11 enters the skin at a relative angle of around 15 degrees, For oblique insertion the hollow needle 11 enters the skin at a relative angle of around 45 degrees, For vertical insertion the hollow needle 11 enters the skin at a relative angle of around 90 degrees.

(4) Acupuncturing locations. Upon insertion, the tip 111 should aim at physical disorder parts, acupoints are selected depending on seriousness of disease. For pain diseases, Tendon membrane trigger points (MTrP) or positive points can be selected as acupuncturing locations. The physical disorder parts or positive points can be identified from: (i) points where it feels sore when pressed, (ii) points where it feels abnormal band or spasm when pressed, (iii) nodular or granular nodules, (iv) points where the patients feels comfortable or symptom relieved when pressed.

Upon insertion, it should avoid black spots, nodules, damages, depressions, protuberances and superficial veins. Since negative pressure is to be applied, care must be taken not to pierce veins. Having connected the host machine 2 and before applying the negative pressure, the doctor must observe whether there is any bleeding. If there is any bleeding, the process must be paused, the needle must be withdrawn and reinserted.

In addition, it is preferable not to perform acupuncture at the lower abdomen to woman pregnant for less than three months. For woman pregnant for more than three months, it is preferable not to perform acupuncture at the lower abdomen, the abdomen and the lumbosacral portion. It is also preferable not to perform acupuncture to patients with spontaneous hemorrhagic disease or patients who cannot stop bleeding after injury.

During one treatment, multiple acupoints can be chosen for multiple acupunctures.

(5) Speed of needle insertion. The speed of insertion should generally be fast. Because the dermis layer has a large amount of nerve endings, the faster the speed of insertion, the less pain that can be felt.

(6) Extent of negative pressure. Different extent of negative pressure is set for different affected regions. In one embodiment, the doctor may choose negative pressure of 20-40 cmHg (0.263-0.526 atm) for head and face; negative pressure of 40 cmHg (0.526 atm) for neck; negative pressure of 70 cmHg (0.921 atm) for waist; negative pressure of 40-50 cmHg (0.526-0.658 atm) for fingers; negative pressure of 50-70 cmHg (0.658-0.921 atm) for upper limbs; negative pressure of 60-76 cmHg (0.789-1 atm) for lower limbs. The extent of negative pressure is selected such that the acupoints, airways and/or meridians and collaterals at the affected regions that are obstructed can be dredged, rigid tendons can become flexible and elastic, and adhered muscle can become soft. It overcomes the poor curative issue of traditional acupuncture therapy; the symptoms of lingering diseases can be relieved immediately.

(7) Timing of needle insertion. It is not appropriate to perform needle insertion when the patient is hungry, tired or tense.

(8) Duration of needle retention. For each acupoint and each acupuncture, the negative pressure in the hollow needle 11 is maintained for no more than 10 minutes, preferably for no more than 5 minutes. In a more preferable embodiment, the negative pressure is maintained for 2-5 minutes.

(9) The method of the present invention must be carried out by registered medical practitioner who has been trained professionally, and with the healthcare machine for dredging meridians and collaterals and the hollow needle of the present invention.

Working Principles

The device and method of the present invention can create continuous negative pressure at the subcutaneous connective tissue adjacent to the tip of the hollow needle, thereby lower the pressure at the region of lesion, relieve congestion, extravasated blood and swelling, and facilitate excretion of algogenic substance. In addition, under continuous negative pressure, tissues like the skin, vein and tendon can be more relaxed, the flow of qi and blood is smoother, metabolism is enhanced and the symptoms of patients can be relived more quickly.

The hollow needle treatment of the present invention is a guidance and regulation of qi and blood. The acupuncture mechanically stimulates the biological effect of the connective tissue, thereby regulate the function (activity of histocyte) and life (repair and regeneration of histocyte) of human body. Subcutaneous loose connective tissue has a liquid crystal state. The needle by means of negative pressure can change the spatial configuration of the liquid crystal state of the loose connective tissue. Due to piezoelectric effect, it releases bioelectricity; when the bioelectricity reaches pathological tissues, it generates converse piezoelectric effect, which changes the ion channels of cells, regulates the disease-resistance mechanism, and dissolves indisposition quickly.

The working principles of the present invention can be generalized as the following aspects:

(1) Dredging Meridians and Collaterals

The meridians and collaterals are channels for qi, blood and body fluid to flow, are conductive system connecting internal organs, body surface and all the body parts. The meridians and collaterals comprise mainly twelve meridians distributed all around the body, they run qi and blood, moisten and nourish internal organs, skins, muscles, tendons and bones, so that various parts can function properly and keep relative balance. Hence the saying "meridians and collaterals can determine life and death, cure all diseases, adjust deficiency and excess, they can't be obstructed".

The theory of Chinese medicine stipulates that pain is an important indication of obstruction of the meridians and collaterals, i.e. "obstruction causes the pain". Therefore, to cure pain it must start with dredging the meridians and collaterals. The hollow needle of the present invention can dredge the meridians and collaterals, regulate qi and blood by means of negative pressure, thereby relieving various diseases resulting from qi stagnation, blood stasis and obstruction of meridians and collaterals for various reasons, especially swelling and pain of limbs and internal organs, numbness of limbs, flaccid and contracture of muscles and hypofunction as a result of obstruction of meridians and collaterals, qi stagnation and blood stasis.

(2) Facilitating Micro-circulation

Loose connective tissue is one of the most common and most influential factors in the human body. All systems of human body are connected with the connective tissue. Loose connective tissue has abundant cells, fibers, blood capillaries, lymphatic capillaries and tissue fluid rich in neurotransmitter (such as acetylcholine).

The hollow needle treatment of the present invention generally chooses region of lesion or MTrp points for needle insertion. It inserts the needle horizontally to subcutaneous shallow and loose connective tissue. By means of negative pressure, it can improve the internal environment of the lesion, particularly enhance regional blood and lymphatic circulation, so that tissues around the lesion can be relaxed, the fibrocytes can restore elasticity, the conduction pathway for neurotransmitter can become unimpeded to play a better role in respective tissues. After the hollow needle treatment, patients can feel rigid and spastic tissues become relieved and nodular nodes and abnormal bands become thin. They feel relaxed and pains relieved after the needle is withdrawn.

(3) Regional Depressurizing

The hollow needle treatment of the present invention can insert needle vertically into the pain sites (i.e. the ashi acupuncture point) and reduce local pressure of the lesion region by applying vacuum, it can relieve regional congestion, extravasated blood and swelling, and facilitate excretion of algogenic substance.

The hollow needle treatment of the present invention can also insert needle around the pain point (up, down, left, right), the insertion site should avoid vessel. By applying continuous negative pressure in the tissue, regional blood circulation can be enhanced, edema can be absorbed, inflammation can be eliminated, the pressured nerve can be relaxed and vessels can restore their functions.

(4) Relaxing

When the muscle tissue is in a tension state, the regional blood circulation can be impeded, causing tissue ischemia and hypoxia. The hollow needle treatment of the present invention can relax the spasm and tension of striated muscle and smooth muscle, can "treat pain with relax" and "kill pain resulting relax". The hollow needle treatment of the present invention can directly excrete the pathogenic factors and excessive phlegm within the meridians and collaterals, can dredge the obstructed meridians and collaterals, and the pain will naturally disappear. Therefore, the hollow needle treatment of the present invention has the function of dissolving spasm and easing pain.

In addition, the hollow needle treatment of the present invention can cause hemangiectasis, facilitate local blood circulation, enhance metabolism, speed up excretion of waste and toxin within body, improve condition of nutrition of local tissues, provide more nutrition to cells, increase hemoperfusion to cells, relax the muscle and relieve fatigue.

(5) Eliminating Inflammation

The hollow needle treatment of the present invention can cure various bacterial inflammation and non-bacterial inflammation, the principle is activating the macrophage within the connective tissue, facilitate lymph circulation and blood circulation, increase the number of lymphocyte and white cells around the lesion, thereby increasing the regression of inflammation.

Based on the above working principles, the device and method of the present invention has wide clinical applications and can achieve good curative effect. The device and method of the present invention are mainly used to treat and/or relieve bounded pain, fullness and distention of limbs, paresthesia such as numbness and pain caused by diseases of internal organs. As unlimiting examples, the device and method of the present invention can be used to treat or relieve:

(i) Soft tissue pain, including but not limited to cervical spondylosis, scapulohumeral periarthritis, tennis elbow, tenosynovitis of the wrist, myofascitis of the back region, hernia of intervertebral discs, the third lumber vertebrae transverse process syndrome, sacroiliitis, gonarthritis, chronic ankle sprains and heel pain.

(ii) Neuro pain, including but not limited to pain following herpes zoster and prosopalgia.

(iii) Chronic visceral pain, including but not limited to stomacheache, cholecystitis, dysmenorrheal and annexitis.

(iv) Non-painful diseases, including but not limited to cervical vertigo, facial paralysis and chronic cough.

(v) General nursing, including but not limited to dredging the twelve medridians, regulating the internal organs, regulating the body and strengthening body immunity.

Effects

The inventor has chosen 14 long-term low back pain patients aged 31-60 for therapeutic test. These patients all have medical histories of longer than 6 months, they exhibit protrusion of the lumbar intervertebral disc observable by MRI due to degeneration of intervertebral disc, rupture of fibrous annulus of lumbar spine, herniation of the nucleus pulposus stimulating or pressurizing nerve root and cauda equina. Typical symptoms include low back pain, radiating ache in lower body and gastrocnemius tension due to pain in lower body. The inventor has quantitatively assessed the stiffness of gastrocnemius of each patient before and after treatment with the hollow needle device and method of the present invention. Axial and morphological information of gastrocnemius is obtained for each patient before and after treatment. From the morphological information stiffness of muscle at the left of the acupoint (AxL) and at the right of the acupoint (AxR) before and after treatment, and stiffness of muscle at the head side (SagH) and at the foot side (SagF) before and after treatment are obtained. The following table shows the measurement results.

| | Location | Mean Value (kPa) | Std. Deviation (kPa) |
|---|---|---|---|
| AxL | Before Treatment | 4.982 | 2.48 |
| | After Treatment | 3.185 | 1.55 |
| AxR | Before Treatment | 5.844 | 2.02 |
| | After Treatment | 3.161 | 1.07 |
| SagH | Before Treatment | 6.055 | 1.49 |
| | After Treatment | 5.383 | 1.08 |
| SagF | Before Treatment | 5.944 | 0.86 |
| | After Treatment | 5.504 | 1.87 |

The above test results show, the MRI confirms the stiffness of gastrocnemius of patient has significant difference before and after hollow needle treatment. After treatment, the regional tendon and muscle become soft, the spasm and pain of patient become relieved.

The applicant has more clinic examples to show the device and method of the present invention have evident clinic efficacy.

(1) 65 years old, male, feet muscle kept rigid for months with swelling and pain, difficult to move freely, no significant improvement after Chinese and western medicine treatment, traditional acupuncture, physiotherapy and specialist treatment. Having been treated by the hollow needle of the present invention, the swelling and pain have been greatly reduced, the original dull color of feet has become white instantly.

(2) 80 years old, female, fell on the ground resulting the lateral thigh swells to the size of half an egg and pain. Having been treated by the hollow needle of the present invention for 3 minutes, the swelling has been reduced by half, and the pain is relieved instantly.

(3) low back pain for years with regional swelling of an area of 2×3 inches and protrusion of half an inch. Having been treated by the hollow needle of the present invention, the swelling has been reduced by 90%.

(4) 46 years old, female, body weight 168 pounds. Having been treated by the hollow needle of the present invention for 7 times, body weight has been reduced by 15 pounds.

(5) 80 years old, male, gait disturbance and gatism, having been treated by the hollow needle of the present invention for once, the frequency of urinary incontinence has been extended from every half an hour to more than two hours, after continuous hollow needle treatment, gait disturbance and gatism have been improved significantly.

(6) 63 years old, male, lung cancer, half of the lung has been cut for 7 years, liver tumor of 5 cm, having conducted chemotherapeutics for twice. When visiting the doctor, the patient looks blush white, has dyspnea, feels listless, sweats a lot during 11 pm to 4 am, experiences hands numbness and shaking and back pain. Having been treated by the hollow needle of the present invention for once, the patient's face instantly turns flushing, he can breathe smoothly and has good complexion. Upon the second visit the next day, the face keeps rosy, there is no sweating in the night and the numbness of hands has been reduced. Upon the third visit, the face remains rosy, the hands no longer feel dumb, and hand shaking has been improved.

In addition, the device and method of the present invention have the following advantages over traditional acupuncture:

The device and method of the present invention use fewer needles over traditional acupuncture, thereby having environmental concepts, reducing pain and pressure to the patient, so that even children and patient in fear of acupuncture can receive treatment.

The device and method of the present invention do not need arrival of qi (rotating the needles to bring about the desired sensation) and sweeping-out (swinging the needles) over traditional acupuncture.

The device and method of the present invention do not generate needling sensation of numb, sour, swelling and pain over traditional acupuncture. Because the needle of the present invention is not inserted too deep, not into the muscular layer, does not stimulate the neural stein cell, therefore will not generate needling sensation of numb, sour, swelling and pain.

The device and method of the present invention is safer over traditional acupuncture. The acupuncture bodily part of the present invention is at the subcutaneous loose connective tissue, it will not contact any important neuro, vessel or organs.

The device and method of the present invention can relieve pain more quickly over traditional acupuncture. The experiments of the inventor show the feel of pain can be relieved within 2 to 5 minutes after the negative pressure is applied. Hence, the duration of needle retention is short.

The above are only parts of the embodiments of the present invention, therefore any equivalent alterations or modifications of the configurations, features and principles, or the combination of various embodiments that are in accordance with the disclosure of the present invention are also within the scope of the present invention.

The invention claimed is:

1. A method of operating a negative pressure device during an acupuncture treatment, comprising the steps of:

acupuncturing at least one hollow needle under a skin of a patient to a subcutaneous connective tissue at one or more acupoints associated with the acupuncture treatment, each of the at least one hollow needle comprising a through hole, connecting the at least one hollow needle to a host machine, the host machine comprising a vacuum pump, and establishing a negative pressure in the through hole of the at least one hollow needle by means of the vacuum pump for a predetermined period of time to ensure no air or drug enters the one or more acupoints so as to dredge one or more meridians or collaterals of a body of the patient.

2. The method according to claim 1, wherein the negative pressure is set in accordance with different acupuncturing body parts including: 20-40 cmHg for head and face, 40 cmHg for neck, 70 cmHg for waist, 40-50 cmHg for fingers, 50-70 cmHg for upper limbs and 60-76 cmHg for lower limbs.

3. The method according to claim 1, further comprising selecting a diameter of a tip of the at least one hollow needle, wherein the diameter of the tip of the least one hollow needle is selected to be between 0.3-0.7 mm.

4. The method according to claim 3, wherein the diameter of the tip of the at least one hollow needle is selected to be between 0.3-0.45 mm for face acupuncture.

5. The method according to claim 3, wherein the diameter of the tip of the at least one hollow needle is selected to be between 0.5-0.7 mm for limbs acupuncture.

6. The method according to claim 1, wherein the acupuncturing is performed at an angle of 15, 45 or 90 degrees relative to the skin.

7. The method according to claim 1, further comprising selecting the one or more acupoints based on the indemnification of physical disorder.

8. The method according to claim 1, wherein the negative pressure is maintained in the through hole of the at least one hollow needle for no longer than 5 minutes.

9. A negative acupuncture pressure treatment method, for treating a disorder of a patient, comprising the steps of:

a) selecting a plurality of acupoints associated with acupuncture treatment of a disorder, b) acupuncturing a hollow needle of an acupuncture device into subcutaneous connective tissue of a patient at a first acupoint of the plurality of acupoints, c) establishing, by means of a through hole of the hollow needle, a fluid channel between subcutaneous connective tissue and a vacuum pump of the acupuncture device exterior to the patient, d) establishing a negative pressure in the fluid channel for a predetermined period of time to ensure no air or drug enters the first acupoint, and e) repeating steps b-d at the other acupoints of the plurality of acupoints, respectively, so as dredge one or more meridians or collaterals of a body of the patient.

10. The method according to claim 9, wherein a diameter of a tip of the hollow needle is between 0.3-0.7 mm.

11. The method according to claim 9, wherein the negative pressure is set in accordance with different acupuncturing body parts including: 20-40 cmHg for head and face, 40 cmHg for neck, 70 cmHg for waist, 40-50 cmHg for fingers, 50-70 cmHg for upper limbs and 60-76 cmHg for lower limbs.

12. The method according to claim 9, further comprising selecting the one or more acupoints based on an identification of a physical disorder.

13. The method according to claim 9, wherein the negative pressure is maintained for no longer than 5 minutes.

* * * * *